United States Patent [19]

Hofmeister

[11] Patent Number: 4,586,766

[45] Date of Patent: May 6, 1986

[54] MULTI-TERMINAL PLUG-SOCKET CONNECTION ARRANGEMENT

[75] Inventor: Werner Hofmeister, Mühlacker, Fed. Rep. of Germany

[73] Assignee: Robert Bosch GmbH, Stuttgart, Fed. Rep. of Germany

[21] Appl. No.: 677,187

[22] Filed: Dec. 3, 1984

[30] Foreign Application Priority Data

Mar. 2, 1984 [DE] Fed. Rep. of Germany ..... 3407725

[51] Int. Cl.[4] ..... H01R 13/629

[52] U.S. Cl. ..... 339/45 M; 339/75 M; 339/91 R

[58] Field of Search ..... 339/45 R, 45 M, 75 R, 339/75 M, 91 R

[56] References Cited

U.S. PATENT DOCUMENTS

| | | | |
|---|---|---|---|
| 2,771,523 | 11/1956 | Stoecklin et al. | 339/75 M |
| 2,899,669 | 8/1959 | Johanson | 339/45 M |
| 2,987,693 | 6/1961 | Wamsley | 339/91 R |

FOREIGN PATENT DOCUMENTS

| | | | |
|---|---|---|---|
| 6406739 | 12/1964 | Netherlands | 339/75 R |
| 2083296 | 3/1982 | United Kingdom | 339/91 R |

*Primary Examiner*—John McQuade

*Attorney, Agent, or Firm*—Frishauf, Holtz, Goodman & Woodward

[57] ABSTRACT

To reduce the engagement force of a multi-terminal plug-and-socket connection, for example having fifty connecting terminals, and reliably positioning the plugs and sockets with respect to each other even upon being subjected to vibration and shock, a handle (13) is provided which is pivoted to the plug element (8, 9) and connected to the plug element by an angled lever (14, 17), the pivot connection (15) being at the end of the angled lever, and, adjacent the apex of the angle of the angled lever, a bolt is located which is operable in a guide track (21), formed as a slit in an upstanding side wall (19) of the socket element (2), the slit being formed with a terminal opening (22) to permit release of the guide bolt (18) from the slit (21) when the handle (13) is raised (chain-dotted position) and consequent disengagement of the plug (8) from the socket (2) by unhooking a pair of interengaging hooks (5, 12) located at the end of the plug-socket connection remote from the handle (13). The arrangement reduces the engagement force required to be applied by an operator for secure interengaging of blade-type terminals by use of the leverage available by the combination of the handle with the angled lever.

14 Claims, 4 Drawing Figures

MULTI-TERMINAL PLUG-SOCKET CONNECTION ARRANGEMENT

Reference to related patent, the disclosure of which is hereby incorporated by reference, assigned to the assignee of the present application: U.S. Pat. No. 4,435,033, Mar. 6, 1984, GANSERT et al.

The present invention relates to a multi-terminal plug-socket connection arrangement, and more particularly to a plug-terminal socket arrangement particularly suitable to connect numerous electrical apparatus or devices, such as sensors, output elements and the like to a microprocessor structure, in which the sensors and output elements form components of a motor vehicle.

BACKGROUND

The referenced U.S. Pat. No. 4,435,033, GANSERT et al., describes a multi-terminal plug-socket connection which is elongated and which has a structure permitting simple, one-hand loosening and attachment. This is a highly satisfactory connection arrangement; yet, if the number of terminals is to be increased even more, so that the overall connector becomes quite long, spring-release of the plug from the socket, upon unlocking, as described in the referenced patent may not be sufficient to separate the plug from the socket. The frictional engagement of many terminal elements, between each other, cannot be readily overcome by springs since, otherwise, the spring force must be so great that an undesirable loading on the engagement and interlocking arrangement of the plug component with the socket component will result. On the other hand, reducing a spring force which assists in separating the plug from the socket detracts from severability of the plug-socket elements.

THE INVENTION

It is an object to provide a multi-terminal plug-socket connection which is simple, can accommodate a large number of terminal tabs or blades to be engaged by socket elements, with excellent engagement contacting characteristics, while permitting easy severability of the plug and socket when desired, preferably by one-hand operation. The arrangement, additionally, should be such that the socket and plug can be engaged or disengaged "blind", that is, by feel only and without requiring visual alignment of the plug alignment with the socket element upon engagement or specific visual attention to the plug-socket combination upon disengagement. This feature is particularly important in automotive vehicles where, frequently, the access to connecting plugs is impaired by elements of the vehicle which, functionally, have nothing to do with the plug-socket connection.

Briefly, the plug and socket elements are both elongated and have, at one end, a hook-and-recess connection so that the plug can be hooked into the socket at one end, while being swung away from the socket at the other. A handle is pivotably connected to one of the elements, typically to the plug element, the handle being operable in a guide track by an interlock with the guide track, for example by a pin extending into a groove formed in the guide track, the guide track guiding the interlock, and hence the handle; the guide track extends in a path which increases the leverage force exerted between the two terminal elements upon closing and pivoting movement of the plug element and the socket element about their hook-shaped pivot point. Preferably, the guide track terminates in a small toggle or over-center recess, to securely lock the handle in position and thereby retain the plug element and the socket element in securely interlocked relation.

The arrangement has the advantage that the operating handle, by the engagement with the guide track, assists in the connecting or disconnecting force, respectively, exerted between the plug element and the socket element, thereby assisting, respectively, connection and disconnection of the socket with or from the plug. The handle can be readily secured to the plug, so that, for example upon connection, movement of the handle will assist the connecting force; upon disconnection, movement of the handle will assist disconnecting forces and permit easier pivoting of the plug away from the socket about the hook-pivot point, for subsequent severing at the hook pivot.

The handle, preferably, is a U-shaped element, pivoted on the plug and extending with its U-legs over and around the plug. The U-legs preferably are angled off to form angled levers which are pivoted on the plug and engaging the guide track which is located on the socket. The arrangement can, of course, also be reversed, although, for ease of operation, the application of the handle to the removable plug on a fixed socket is preferred.

The arrangement is particularly suitable for use in vehicles, subjected to rough operating conditions, including shock, vibration, ambient changes in humidity, temperature, and, for example, corrosive atmospheres. The plug-socket connection is reliable, even for large numbers of terminals in which the connecting forces are substantial, and in which the connecting efficiency must be high; the switch or connection voltage drop should, preferably, be in the region of zero, although the plug-socket arrangement must be highly resistant to oscillations, accelerating and decelerating forces, vibration and the like, which are usually encountered in automotive use. Yet, reliable engagement and disengagement is important. The plug-socket connection reduces the engagement and disengagement forces necessary to be applied to the plug and/or the socket by use of leverage effected by the angled-off lever formed by the legs of U-handle.

DRAWINGS

DETAILED DESCRIPTION

Figure 1:
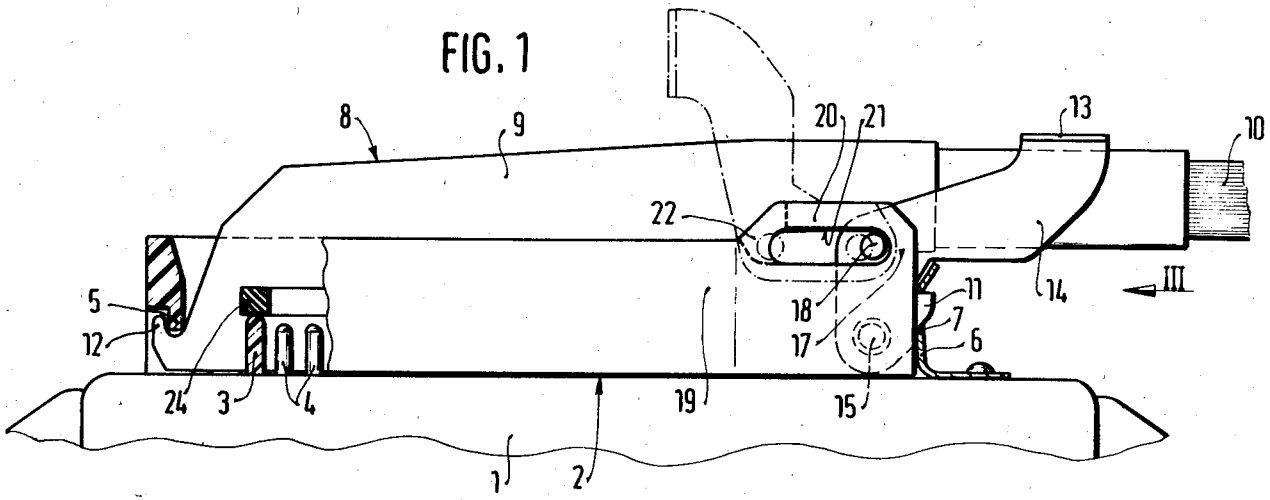
FIG. 1 is a side view of the plug-socket arrangement, in connected position.

The multi-terminal plug-socket connection has a socket element 2 which, for example, is attached to a housing 1 of an electrical control apparatus, or, for example, of a feed-through, for example through the fire wall of an automotive vehicle; the base 1 may, also, be the housing of a microcomputer receiving inputs from a plurality of sensors, and providing outputs to respective automotive apparatus or devices, for example to control fuel injection, timing of ignition sparks, and the like.

The socket 2, externally, is made, for example and preferably, of an insulated plastic. It retains a terminal strip 3 having a large number of flat blade connectors 4, for example fifty flat blade connectors, which are retained in the terminal strip 3 in one, two or more rows. The structure is elongated. A holder element 5, in form of an engagement hook, is located at one narrow end portion of the socket 2. The opposite side of the socket has a holding spring 6 secured therein formed with a receiving opening 7 to receive a projection 11 of the plug, as will appear.

The plug 8 is an elongated plastic structure, formed as plug housing 9, with lateral gripping recesses, for easy gripping by one hand of an operator. The connecting terminals within the plug element 9 are not shown and may be of any suitable construction to match the projecting pins or blade terminals 4 on the socket, to form wiping contact and secure electrical connections therewith. The electrical terminals within the plug housing 9 are internally electrically connected to a multi-conductor cable 10 which leaves the housing 9 in the region of the hand grip thereof at one narrow end portion. The same end portion is formed with a projection 11, which fits into the engagement opening 7 of the spring 6 to provide for secure interlocked engagement and prevent accidental removal of the plug 8 from the socket 2.

The other narrow end side of the plug 8 is formed with a projecting engagement hook 12, fitting beneath a hook portion 5 of the socket 2.

Initial engagement: To engage the plug 8 with the socket 2, the plug 8 is swung upwardly from the position shown in FIG. 1, and the hook 12 on the plug 8 is fitted beneath the hook 5 of the socket 2; the plug 8 is then swung downwardly—with respect to FIG. 1—about the hook 5 which forms a pivot for the hook 12. This engages the respective internal connections within the plug 8 on the connecting blades 4. When all the internal connectors are connected with the connecting blades 4, and the plug 8 is closed against the socket 2, that is, will be in the position shown in FIG. 1, the plug-socket combination is completely connected, and the spring 6 will be in the position shown in FIG. 1, that is, with the projection 11 on the socket snapped into the opening 7 of the spring 6. The spring 6, snapped around the opening 11, securely retains the plug and socket in connected condition.

Removing operation—unplugging: To remove the plug 8 from the socket 2, and to withdraw the internal connections on the plug from the terminals 4, the spring 6 is bent outwardly to clear the projection 11, and the plug 8 is swung upwardly about the pivot formed by the interengaging hooks 5, 12. When the plug 8 has been moved sufficiently upwardly, the plug 8 can be slid out from under the hook 5 and removed. This is necessary, for example, if the plug unit 2, which may be rigidly secured to the housing of a microprocessor located within the housing structure 1, is to be entirely exchanged, for example in case of malfunction of the microprocessor.

The high requirements placed on the security of connection of the terminals between the socket 2 and the plug 8 necessitate that the engagement force exerted upon connection of the plug to the socket be high; the disengagment force, however, should still be reasonable. In accordance with a feature of the invention, the forces necessary for an operator to engage and disengage the plug with, or from, the socket are reduced, while retaining high connecting forces.

Figure 2:
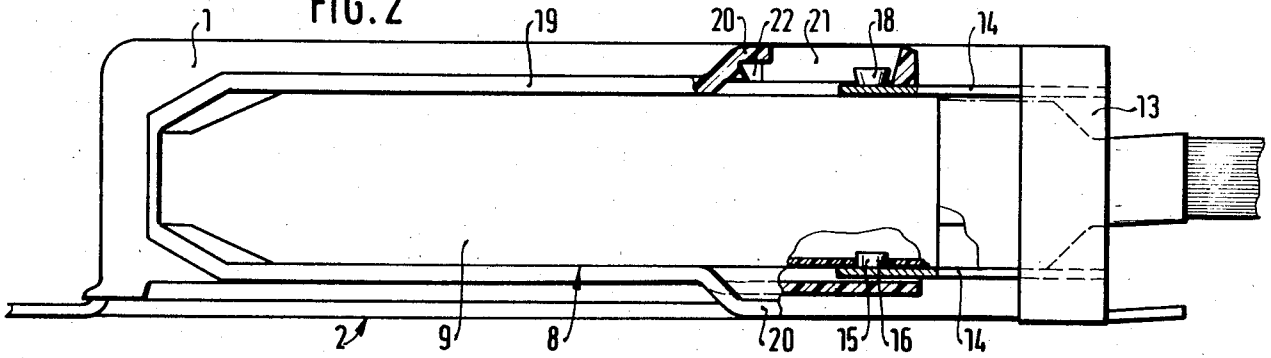
FIG. 2 is a top view, partly in section, of the plug-socket arrangement, when connected together.
Figure 3:
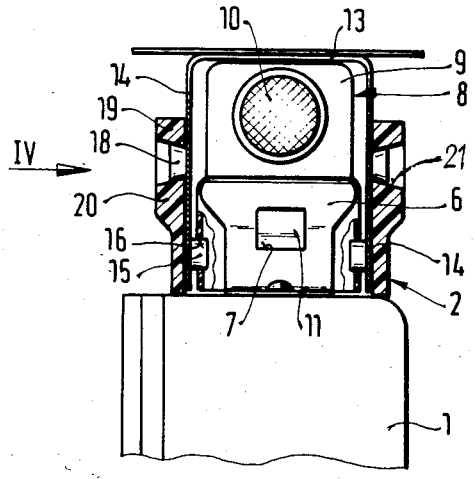
FIG. 3 is a part-sectional view of the connection arrangement taken along arrow III of FIG. 1.

In accordance with a feature of the invention, an auxiliary connecting arrangement is provided, formed, essentially, by a U-shaped handle 13 having leg portions 14 which are angled, so that, in side view, the handle is somewhat Z-shaped. A bolt 15 is secured close to the free end of each leg 14, projecting inwardly from the legs 14 and pivotably received in an opening 16 of the housing 9 of the plug 8 (FIG. 2) to pivot about the axis of the bolt 15. Guide bolts 18—see FIG. 2—are located in the region of the apices of the angle of the lever formed by the leg 14, the bolts 18 being secured to the legs 14. The bolts 18 project outwardly from the legs 14.

The socket 2 is formed with upstanding guide rims 19 extending along the longitudinal sides of the terminal strip 3. The guide rims 19 have a raised, outwardly thickened portion 20 in the zone remote from the hook 5. The thickened portions 20 are formed with a slit 21 which is continued, outwardly, at least in part in an elongated hole. The slit 21 forms a guide track, together with the elongated hole, which extends in the longitudinal direction of the socket 2. In the region of the slit closest to the hook 5, an enlarged insertion region 22 is formed.

Figure 4:
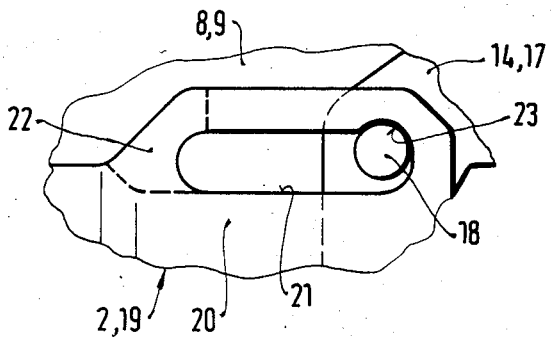
FIG. 4 is a fragmentary detail view, to an enlarged scale, taken along the arrow IV in FIG. 3.

As best seen in FIG. 4, the inner end 23 of the slit is upwardly slightly enlarged to form locking positions for the guide bolts 18 of the handle 13. The guide bolts 18, and the slits 21, are outwardly slightly conically enlarged—see FIG. 2. The conical guide bolts 18, thus, are reliably guided in the slits 21 which, likewise, have a tapering cross section, to match the conical configuration of the bolts 18.

Operation—connecting the plug to the socket: First, the plug 8 is hooked in the socket 2 by interengaging the connecting hooks 12 and 5. The U-shaped handle 13 is placed at least approximately in the position shown in chain-dotted lines in FIG. 1. Only the handle 13 is shown in raised position in chain-dotted lines; the pivoted position of the plug 8 is not so shown.

The portions of the legs 14 up to the region 17, that is, the portions between the bolts 15 and 18, will be approximately parallel to the lower edge of the plug 8. The plug 8 is then pivoted about the interengaging hooks 5, 12 towards the socket 2 by moving the plug 8 towards the socket 2. The guide bolts 18 on the handle 13 will then reach the insertion region 22 of the slits 21 and will enter the slit 21. For further closing of the plug 8 against the socket 2, the handle 13 is then pivoted about the pivot connection 15 which will cause the guide bolts 18 to slide in the slits 21. This will cause the plug 8 to be drawn towards the socket 2 by the connection over the bolt 15 of the legs 14. A lever action now occurs, and, due to the leverage obtained, substantially less final engagement force need be applied by the operator on the plug housing 9 for engagement of the terminals in the plug 8 with the terminals in the socket 2.

In accordance with a preferred feature of the invention, those interconnecting terminal elements which require a greater degree of engagement force, are located close to the end where the handle is located; terminal elements which require less engagement force are preferably located closer to the interengaging hook pivot 5, 12. Flat blade connectors or sleeve-pin connectors usually require more engagement force than wiping spring-pressed terminals.

When the plug is completely closed, the guide bolts 18 will engage the enlarged ends 23 of the slit 21 and snap in, with slight "over-center" position. They are there held by a resilient force applied by a sealing strip 24 (FIG. 1) located, for example, within the plug unit. Usually, the lock effected by the enlarged end 23 of the slit 21 is sufficient to hold the plug securely in the socket. The spring lock formed by the projection 11 fitting into the opening 7 of spring 6 is an additional safety connection which is suitable if particularly high requirements are placed on the connection with respect to resistance to vibration, socket and the like, and, further, to prevent disengagement if, contrary to the instructions, for example, someone lifts the handle 13. This is particularly desirable if the arrangement is located in the engine compartment of a motor vehicle in which, for example, the entire unit 1 together with the connecting plug and socket arrangement 8, 2 is so positioned that the unit is visually difficult to inspect. The unit can be closed and opened by "feel".

Disconnecting the plug from the socket: First, the snap spring 6 is released from the projection 11 and, then, the handle 13 is pivoted backwardly. This can be done by one hand, by pressing the spring 6 with one finger while raising the handle 13 with the remainder of the hand. As the lever 13 is pivoted backwardly—the spring 6 is released quickly—the guide bolt 18 is first moved against the resilient force of the seal 24 from the end 23 of the slit downwardly and then, with only little force applied on the U-shaped handle 13, out of the slit 21. The bolt 15, simultaneously, pivots the plug 8 from complete, tight engagement with the socket 2. The handle 13 is then again moved in the position in which the portion 17 between the bolts 15 and 18 of the handle 13 is approximately parallel to the lower edge of the plug housing 9. This places the bolts 18 into the release opening 22, permitting the plug 8 to completely pivot outwardly and so that the plug 8 and the housing 9 can be severed from the socket 2, thus separating the elements 2, 8.

Various changes and modifications may be made within the scope of the inventive concept.

I claim:

1. Multi-terminal plug-socket connection arrangement comprising an elongated strip-like plug terminal element (8) and an elongated strip-like socket terminal element (2);

an interlocking, releasable interfitting hook-pivot connection (5, 12) at one end of said elements;

and an interengaging locking connection at the other end of the elements to releasably lock said elements together upon pivoting movement about the hook-pivot connection (5, 12), a handle (13) pivotably connected to one (8) of said terminal elements (2, 8) at the side remote from the hook-pivot connection and including an angled lever (14, 17);

a guide track (21–23) formed on the other (2) of said elements (2, 8);

and interlocking means formed on said angled lever constraining movement of said angled lever and said handle to follow said guide track during relative pivoting movement of said elements, said guide track guiding the interlocking means and hence the handle to extend in a path which increases by leverage, an engagement force exerted between said terminal elements (2, 8) upon closing pivoting movement of said terminal elements about said interfitting hook-pivot connection (5, 12).

2. Arrangement according to claim 1, wherein a portion (18) of said interlocking means comprises a guide bolt (18) being secured to the angled lever;

and wherein said guide track includes a slit (21–23) receiving said guide bolt (18) to guide movement of the angled lever in the slit defining the guide track, said one of the elements comprising a movable plug element (8) and the other element comprises a fixed socket element (2), said movable plug element (8) being selectively removable from said fixed socket element.

3. Arrangement according to claim 2, wherein the handle (13) and the lever form a unitary generally U-shaped structure, in which the legs of the U form two angled levers (14, 17) reaching around said movable plug terminal elements (8);

pivot connection (15) pivotably interconnecting an end of each of the angled levers forming the legs of the U with said movable plug terminal element (8);

the socket element (2) being formed with two upstanding guide rims (19), each of said guide rims being formed with a slit defining said guide track;

and wherein two guide bolts (18) are provided, located in the zone of the apex of the angle of the angled lever, the guide bolts moving in respective guide tracks.

4. Arrangement according to claim 3, wherein the guide tracks are formed with a locking position (23) receiving the guide bolts.

5. Arrangement according to claim 4, wherein the locking position comprises an over-center position.

6. Arangement according to claim 1, further including a positive safety interlock (6, 7, 11) including interengaging positive locking elements formed, respectively, on said terminal elements for positively locking said terminal elements together.

7. Arrangement according to claim 3, wherein said guide bolts (18) are conical;

and the guide tracks include slits having inclined side walls matching the cone angle of the conical bolts to provide for positive interlock of the guide bolts in the slits and positive guidance of the guide bolts in the guide tracks defined by said slits.

8. Arrangement according to claim 3, wherein the guide rims (19) extend longitudinally of the strip-like plug terminal element (2);

and said slits (21) are formed in said guide rims.

9. Arrangement according to claim 1, wherein said interlocking means comprises projecting pins or bolts (18) and slits (21) formed as part of the guide track.

10. Arrangement according to claim 3, wherein said slits are formed with an open entering portion (22) permitting entry of said guide bolts (18) into said slits and subsequent travel of said guide bolts (18) in said slits defining the guide track, said open entry portions permitting release of the interlocking means for severing the terminal elements from each other.

11. Arrangement according to claim 3, wherein said slits are essentially straight and extend essentially parallel to the major direction of the elongated strip-like socket terminal element (2).

12. Arrangement according to claim 10, wherein said slits are essentially straight and extend essentially parallel to the major direction of the elongated strip-like socket terminal element (2).

13. Arrangement according to claim 11, wherein said guide bolts (18) are conical;

and the guide tracks include slits having inclined side walls matching the cone angle of the conical bolts to provide for positive interlock of the guide bolts in the slits and positive guidance of the guide bolts in the guide tracks defined by said slits.

14. Arrangement according to claim 12, wherein said guide bolts (18) are conical;

and the guide tracks include slits having inclined side walls matching the cone angle of the conical bolts to provide for positive interlock of the guide bolts in the slits and positive guidance of the guide bolts in the guide tracks defined by said slits.

* * * * *